US007357220B2

(12) United States Patent
Horikou

(10) Patent No.: US 7,357,220 B2
(45) Date of Patent: Apr. 15, 2008

(54) SYSTEMS AND METHODS FOR CONTROLLING ACOUSTICAL DAMPING

(75) Inventor: Yukihisa Horikou, Nagoya (JP)

(73) Assignee: Toyota Boshoku Kabushiki Kaisha, Aichi-ken (JP)

( * ) Notice: Subject to any disclaimer, the term of this patent is extended or adjusted under 35 U.S.C. 154(b) by 357 days.

(21) Appl. No.: 11/096,166

(22) Filed: Mar. 31, 2005

(65) Prior Publication Data

US 2005/0217930 A1 Oct. 6, 2005

(30) Foreign Application Priority Data

Mar. 31, 2004 (JP) ..... 2004-104173

(51) Int. Cl.
*F01N 1/02* (2006.01)

(52) U.S. Cl. ..... 181/250; 181/278; 181/271; 181/277; 181/276; 123/184.59; 381/71.4; 381/86

(58) Field of Classification Search ..... 181/278, 181/271, 277, 276, 266, 250, 215, 216, 241, 181/219, 237; 381/71.4, 86; 123/184.59
See application file for complete search history.

(56) References Cited

U.S. PATENT DOCUMENTS 6,688,422 B2 * 2/2004 Fuesser et al. ..... 181/206
6,912,286 B1 * 6/2005 Daly ..... 381/71.1
6,932,189 B2 * 8/2005 Helber et al. ..... 181/240
7,106,867 B2 * 9/2006 Daly ..... 381/71.4
7,155,333 B1 * 12/2006 Abram et al. ..... 701/111
2002/0039422 A1 * 4/2002 Daly ..... 381/71.4
2002/0136415 A1 * 9/2002 Daly ..... 381/71.4
2002/0168071 A1 * 11/2002 Daly ..... 381/71.4
2003/0057015 A1 * 3/2003 Helber et al. ..... 181/240
2005/0089177 A1 * 4/2005 Hughes et al. ..... 381/86
2005/0121256 A1 * 6/2005 Hofmann et al. ..... 181/271
2005/0133300 A1 * 6/2005 Hofmann et al. ..... 181/250
2005/0203684 A1 * 9/2005 Borgesson ..... 701/36
2005/0252716 A1 * 11/2005 Moenssen et al. ..... 181/277
2006/0002568 A1 * 1/2006 Cuddihy et al. ..... 381/71.4
2007/0112476 A1 * 5/2007 Obradovich ..... 701/1

FOREIGN PATENT DOCUMENTS

JP 05-288033 11/1993

* cited by examiner

*Primary Examiner*—Lincoln Donovan
*Assistant Examiner*—Forrest Phillips
(74) *Attorney, Agent, or Firm*—Patterson, Thuente, Skaar & Christensen, P.A.

(57) ABSTRACT

A control system (10) controls a variable acoustical damping device (20) disposed in a sound producing channel (5) of a vehicle engine (1). The control system includes a controller (12) and a selection device (14). The controller is coupled to the variable acoustical damping device and stores a plurality of control patterns (A. B) for different levels of acoustical damping of the acoustical damping device. The selection device outputs a selection signal to the controller so that the controller controls the variable acoustical damping device based on one of the control patterns corresponding to the selection signal.

15 Claims, 4 Drawing Sheets

SYSTEMS AND METHODS FOR CONTROLLING ACOUSTICAL DAMPING

This application claims priority to Japanese patent application serial number 2004-104173, the contents of which are incorporated herein by reference.

BACKGROUND OF THE INVENTION

1. Field of the Invention

The present invention relates to systems and methods for controlling acoustical damping of intake air sound or exhaust air sound of vehicle engines.

2. Description of the Related Art

A Helmholz resonator is known as an acoustical damping device. As shown in FIG. 4, a known Helmholz resonator 90 is configured by a branch tube 94 connected to an intake air duct 92 of an engine and by a closed chamber 96 connected to the branch tube 94. Damping frequency or resonance frequency f of the resonator 90 is determined by cross-sectional area S of the branch tube 94, length L of the branch tube 94 and volume V of the chamber 96, and is represented by:

$$f = \frac{c}{2\pi}\sqrt{\frac{S}{LV}}$$

where c is the sonic velocity (i.e., 340 m/s). In the case of intake air noise that may be produced due to the pulsation of the intake air supplied to an engine, the noise level may have a peak value at a specific frequency F corresponding to the rotational speed of the engine. Therefore, in principle, the noise level at the specific frequency F may be reduced by controlling the resonance frequency f of the resonator 90 to coincide with the specific frequency F of the intake air noise corresponding to the rotational speed of the engine. Thus, the intake air sound may be generally reduced overall because the intake air sound at the frequency F, at which the sound level has a peak value, may be reduced. The resonator 90 may also reduce the exhausted air noise in the same way.

In order to have the resonance frequency f coincide with the frequency F of the intake air sound (or exhaust air sound) corresponding to the rotational speed of the engine, Japanese Laid-Open Patent Publication No. 5-288033 teaches the ability to change the length L of the branch tube 94 and the cross-sectional area S of the branch tube 94.

As noted above, the resonator 90 is generally used for minimizing the intake air sound or the exhaust air sound of the engine. However, during traveling for the sake of enjoying sporty driving, it is not possible to obtain a vigorous feeling or enthusiastic feedback if the intake air sound or the exhaust air sound is low. The intake or exhaust air sound may not be loud enough for a driver or a passenger to enjoy during these situations. Consequently for such an occasion, it is preferable to increase the intake air sound or the exhaust air sound by an appropriate degree. Conversely, it is also preferable to minimize the intake air sound or the exhaust air sound during the playing of audio equipment or when attempting to have a quiet conversation.

SUMMARY OF THE INVENTION

It is accordingly an object of the present invention to teach improved control systems for controlling variable acoustical damping devices, which systems may reduce or dampen the generation of sound in sound producing channels (i.e., an intake air sound or an exhaust air sound) to a suitable level in response to use conditions of a vehicle.

In one aspect of the present teachings, control systems for controlling variable acoustical damping devices are taught. The variable acoustical damping device may be disposed in sound producing channels, for example, the intake air channels or exhaust air channels of vehicle engines. The control systems may include a controller and a selection device. The controller is coupled to the variable acoustical damping device and stores a plurality of control patterns for differing the level of acoustical damping of the acoustical damping device. The selection device may output a selection signal to the controller so that the controller operates the variable acoustical damping device based on one of the control patterns corresponding to the selection signal.

Therefore, the damping effect of the variable acoustical damping device can be varied in response to a control pattern corresponding to the output signal of the selection device. In this way, it is possible to present a more suitable or desired intake air sound or exhaust air sound in response to the use conditions of the vehicle. For example, it is possible to present a more vigorous intake air sound or exhaust air sound during sporty traveling, or alternatively, to minimize the intake or exhaust air sound during the playing of an audio device.

In another aspect of the present teachings, the variable acoustical damping device is a resonator having a variable resonance frequency. The control patterns of the controller include a first pattern and a second pattern. The first pattern controls the resonance frequency of the variable acoustical damping device to substantially coincide with the frequency of the intake or exhaust sounds corresponding to the rotational speed of the vehicle engine. The second pattern controls the resonance frequency of the variable acoustical damping device so as to not coincide with or to be actively shifted away from the frequency of the intake or exhaust sounds corresponding to the rotational speed of the vehicle engine.

Therefore, when the first pattern has been selected, the sound of the intake or exhaust air at a peak frequency level can be lowered due to a resonance effect. As a result, the overall intake or exhaust air sound may be minimized. When the second pattern has been selected, the sound of the intake or exhaust air at a frequency corresponding to the peak level may not be lowered in comparison with the first pattern. As a result, the intake or exhaust air sound may be louder in the second pattern relative to the first pattern.

The selection device may be chosen from at least one of an operating mode selection switch of a vehicle automatic transmission, a vehicle audio device, a vehicle lighting switch, a vehicle air conditioning switch, a wiper switch, a window switch for opening and closing at least one vehicle window, and a sensor for detecting the seating of passengers on vehicle seats.

If the selection device is an operating mode selection switch of a vehicle automatic transmission (e.g., typically used for selection between a normal mode and a power mode), the first pattern may be selected when the operating mode selection switch is switched to a normal mode. The second pattern may be selected when the operating mode selection switch is switched to a power mode. Therefore, if the power mode has been selected, the second pattern may be selected to present a louder and more vigorous intake or exhaust air sound, allowing the driver and other passengers to enjoy a more powerful feeling during sporty traveling.

Preferably, the selection device includes the power switch of a vehicle audio device in addition to the operating mode selection switch of the vehicle automatic transmission. The first pattern may be selected when the power switch of the audio device is turned on, even when the position of the operation mode selection switch is set to the power mode. The driver or passenger can therefore enjoy the playing of the audio device in a more silent vehicle cabin.

In another aspect of the present teachings, methods of controlling the sound produced by sound producing channels (e.g., intake air sound or exhaust air sound) of vehicle engines are taught. The methods may include the steps of providing a controller storing different control patterns with respect to acoustical damping, selecting one of the control patterns; and controlling the intake air sound according to the selected control pattern. Therefore, the intake or exhaust air sound may be increased or decreased in response to various vehicle conditions.

The selection step may include the step of detecting various vehicle conditions, including at least one of the conditions such as the condition of a vehicle automatic transmission, a vehicle audio device, a vehicle lighting switch, a vehicle air conditioner, a wiper switch, a sensor for detecting at least one seated persons, and at least one window regulator.

In one embodiment, the controlling step may include varying the acoustical damping level of an acoustical damping device disposed in an intake air channel or an exhaust air channel. The control pattern includes at least a first control pattern and a second control pattern. The first control pattern provides the maximum possible damping effect via the acoustical damping device. The second control pattern provides a damping effect smaller or less than the maximum damping effect.

DETAILED DESCRIPTION OF THE INVENTION

Each of the additional features and teachings disclosed above and below may be utilized separately or in conjunction with other features and teachings to provide improved systems and methods for controlling acoustical damping. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative embodiment of the present invention will now be described with reference to FIGS. 1 to 3.

Figure 1:
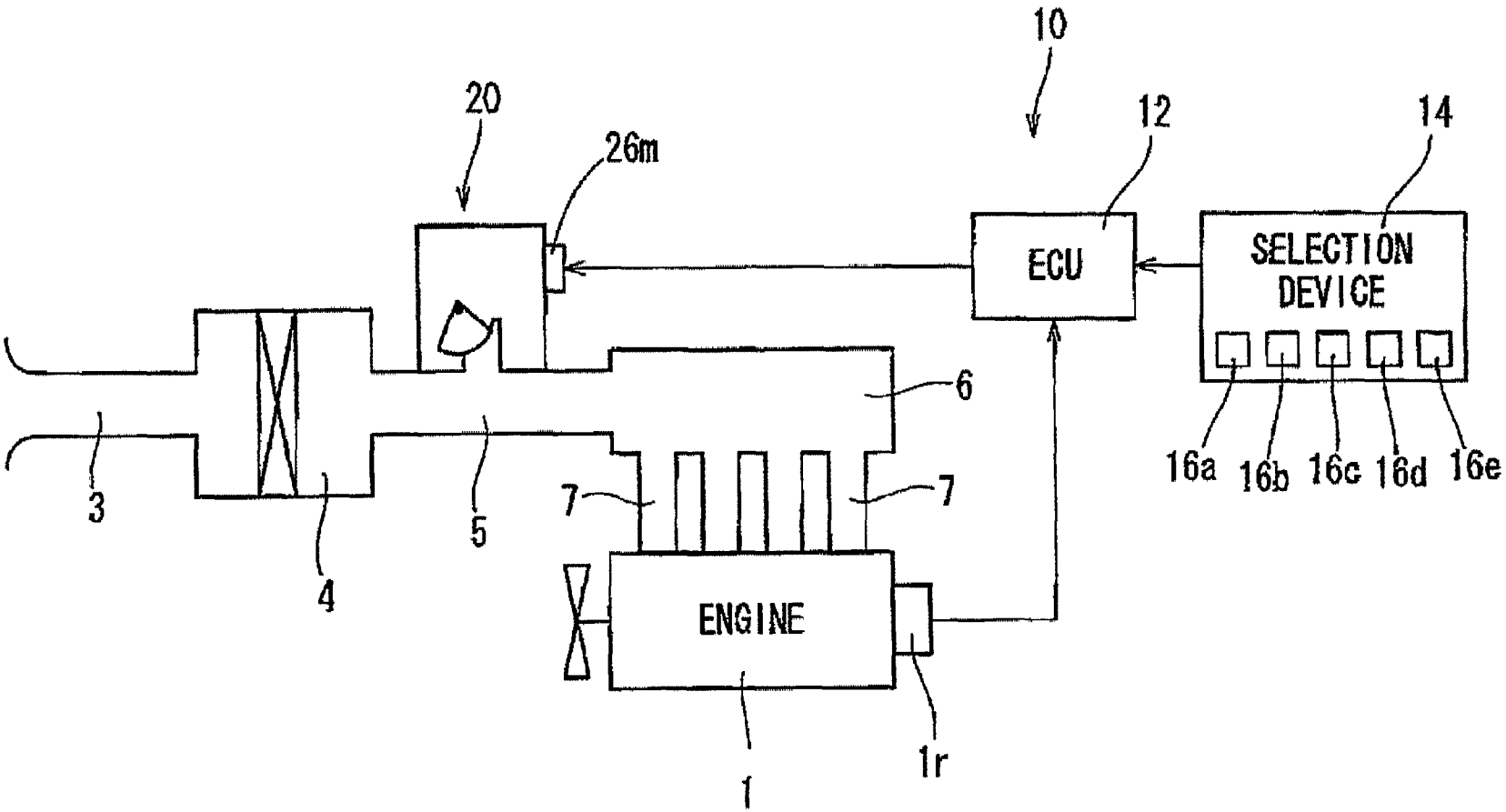
FIG. 1 is a schematic diagram showing a system for controlling a variable acoustical damping device according to a representative embodiment of the present invention.

Referring to FIG. 1, a path of intake air supplied to an engine 1 includes an inlet duct 3, an air cleaner 4, an intake air pipe 5, a serge tank 6, and an intake manifold 7. The air outside of a vehicle, such as an automobile, may enter the air cleaner 4 via the inlet duct 3. The air may be filtered by the air cleaner 4 and may then enter the serge tank 6 via the intake air pipe 5. Subsequently, the air may be supplied from the serge tank 6 to the intake manifold 7, which is branched to supply the air to corresponding cylinders (not shown) of the engine 1.

A variable acoustical damping device 20 is mounted to the intake air pipe 5 and is adapted to be controlled by a control system 10.

The control system 10 is configured to control the intake air sound of the engine 1 by adjusting the resonance frequency f of the acoustical damping device 20. The control system 10 includes an electronic control unit 12 (ECU) for controlling the acoustical damping device 20 and a selection device 14 for selecting a control pattern of the electronic control unit (ECU) 12.

In this representative embodiment, the acoustical damping device 20 is configured as a resonator, known as a Helmholz resonator, which is operable to reduce the intake air sound by utilizing the Helmholz's resonance principle. As shown in FIG. 2, the acoustical damping device 20 includes a substantially sealed resonance chamber 22. The resonance chamber 22 is connected to the intake air pipe 5. The resonance chamber 22 defines an inner space that communicates with the intake air pipe 5 via a branch pipe 24. The branch pipe 24 has a base end 24*m* (i.e., the upper end as viewed in FIG. 2) connected to the intake air pipe 5 and extending downward into the resonance chamber 22. The branch pipe 24 opens into the intake air pipe 5 at the base end 24*m* and opens into the resonance chamber 22 via an opening 25. The opening 25 includes a terminal opening 25*f* and a concave arc-shaped opening 25*e* that extends from one side of the terminal opening 25*f* to a position adjacent to the base end 24*m* of the branch pipe 24. The arc-shaped opening 25*e* may be opened and closed by a pie shaped section movable plate 26, as will be hereinafter described.

The movable plate 26 has an arc-shaped outer peripheral edge configured with a curvature substantially equal to the curvature of the arc-shaped opening 25*e* of the branch tube 24. A cover 26*h* is formed with the movable plate 26 and extends along the outer peripheral edge in order to open and close the arc-shaped opening 25*e*. A rotary shaft 26*s* is fixedly mounted to the movable plate in a position corresponding to the center of curvature of the arc-shaped outer peripheral edge 26*h*. The rotary shaft 26*s* is coupled to a motor 26*m* (see FIG. 1) so that the movable plate 26 is pivoted about the rotary shaft 26*s* as the motor 26*m* is driven. As the movable plate 26 pivots, the cover 26*h* slidably moves along the arc-shaped opening 25*e* of the branch tube 24, allowing the adjustment of the open area of the arc-shaped opening 25*e*.

Figure 2:
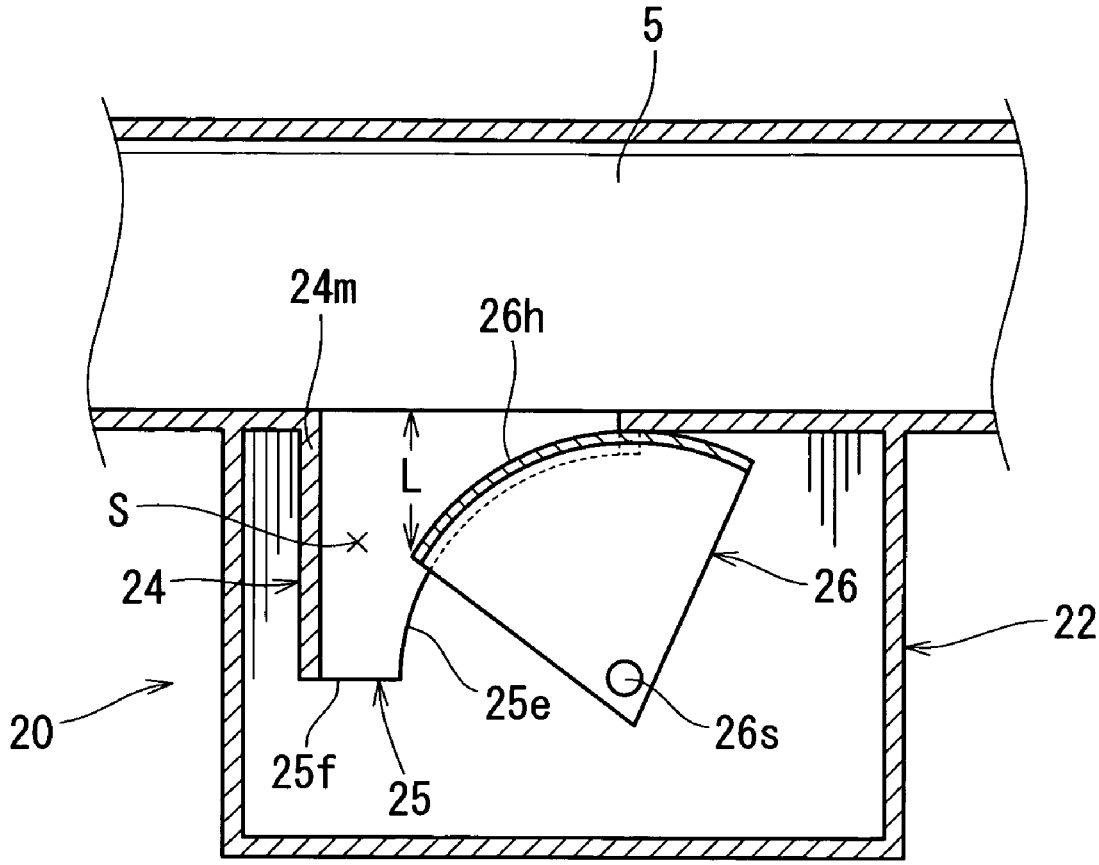
FIG. 2 is a vertical sectional view of the variable acoustic damping device.
Figure 3:
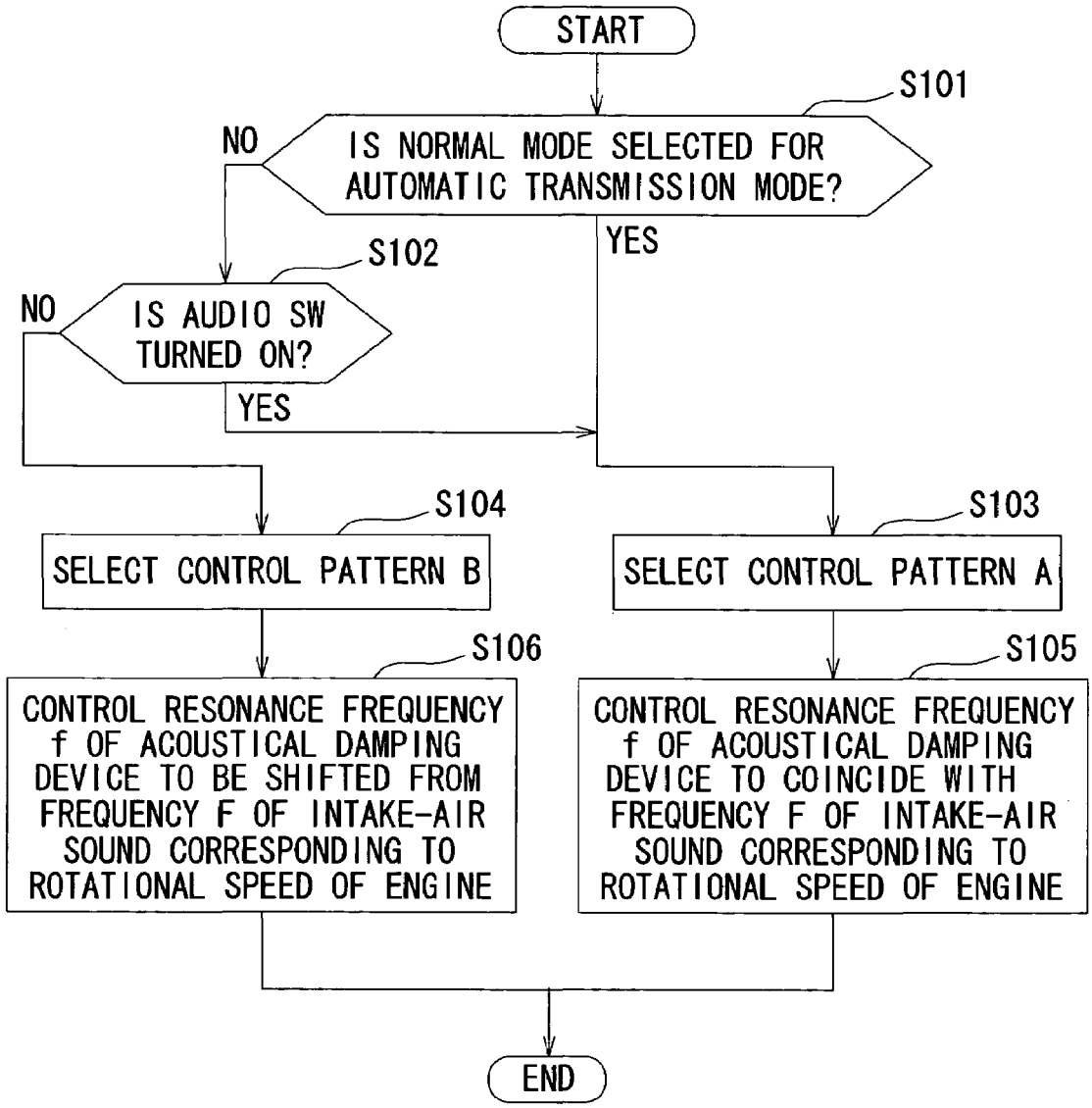
FIG. 3 is a flow chart showing the operation of the system.
Figure 4:
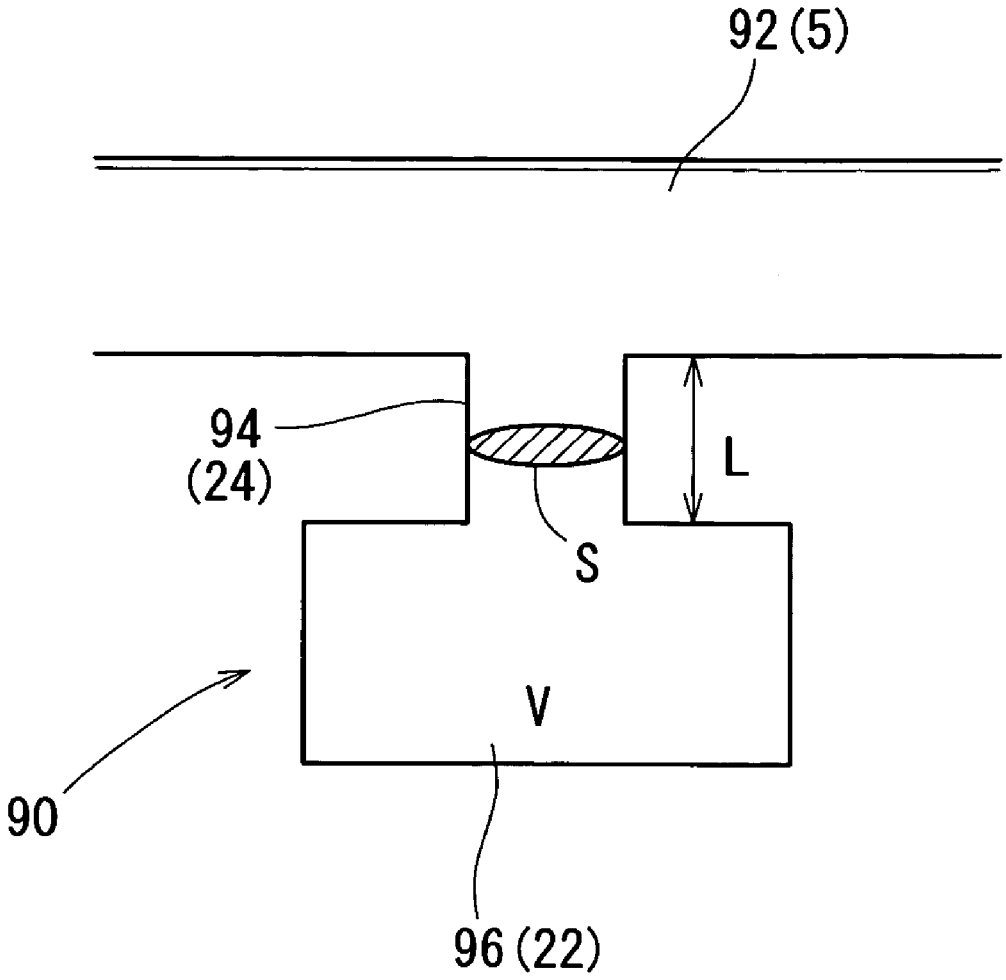
FIG. 4 is a schematic view of a known resonator.

Thus, as the movable plate 26 is pivoted by the motor 26*m* in a counterclockwise direction as viewed in FIG. 2, the open area of the arc-shaped opening 25*e* may be reduced so that overall open area S of the opening 25 may be reduced, but effective length L of the branch tube 24 may be increased. Therefore, the resonance frequency given by the following expression may be lowered.

$$f = \frac{c}{2\pi}\sqrt{\frac{S}{LV}}$$

On the contrary, as the movable plate 26 is pivoted by the motor 26*m* in a clockwise direction as viewed in FIG. 2, the open area of the arc-shaped opening 25*e* may be increased so that the overall open area S of the opening 25 may be increased, but the effective length L of the branch tube 24 may be decreased. Therefore, the resonance frequency f given by the above expression may be increased.

The rotation of the motor 26*m* for driving the movable plate 26 is controlled by control signals outputted from the electronic control unit (ECU) 12. In this representative embodiment, two patterns (i.e., Control Pattern A and Control Pattern B) of the control programs are stored in the electronic control unit (ECU) 12 in order to control the rotation of the motor 26*m*.

According to Control Pattern A, the electronic control unit (ECU) 12 controls the motor 26*m* in order that the resonance frequency f of the variable acoustical damping device 20 coincides with the frequency F of the intake air sound corresponding to the rotational speed R of the engine 1. As previously noted, the intake air sound level has a peak value at a frequency F, specifically corresponding to the rotational speed R of the engine 1.

In the case that the engine 1 is a four-cycle engine, the frequency F may be given by the following expression:

$$F = \frac{1}{2} \times R \times \frac{1}{60} \times s \times n$$

where s is the number of cylinders and n is an integer (1, 2, 3, - - - ). As shown by the expression, the frequency F may increase as the engine rotational speed R increases. Conversely, the frequency F may decrease as the engine rotational speed R decreases. The rotational speed R of the engine 1 may be detected by a rotational speed sensor 1*r* (see FIG. 1), which outputs a detection signal to the electronic control unit (ECU) 12.

According to Control Pattern A, the motor 26*m* of the variable acoustical damping device 20 may be controlled such that the resonance frequency f of the variable acoustical damping device 20 substantially coincides with the frequency F of the intake air sound corresponding to the rotational speed R of the engine 1. As a result, the intake air sound at the frequency F, at which the sound level of the intake air has a peak value, may be significantly reduced. The intake air sound of the engine 1 may therefore be generally low.

According to Control Pattern B, the motor 26*m* may be controlled such that the resonance frequency of the variable acoustic damping device 20 does not coincide with or may be actively shifted from the frequency F of the intake air sound corresponding to the rotational speed R of the engine 1. Therefore, the intake air sound at a frequency F may not be significantly reduced. As a result, the intake air sound of the engine 1 may generally remain relatively high.

Consequently, Control Pattern A may be referred to as a "significant acoustical damping pattern." Alternatively, Control Pattern B may be called a "moderate acoustical damping pattern."

A selection device 14 may output a selection signal to the electronic control unit (ECU) 12 so that either Control Pattern A or Control Pattern B may be selected based upon the section signal. In this representative embodiment, an operating mode section switch of an automatic transmission of the automobile (not shown) is used as the selection device 14. In general, the mode selection switch is operable by the driver of the automobile in order to select an operating mode from between a normal mode and a power mode. When the driver operates the operating mode selection switch to change the operating mode from the power mode to the normal mode, the operating mode selection switch may output a corresponding selection signal to the electronic control unit (ECU) 12, selecting Control Pattern A. Alternatively, when the driver operates the operating mode selection switch to change the operating mode from the normal mode to the power mode, the operating mode selection switch may output a different corresponding selection signal to the electronic control unit (ECU) 12, selecting Control Pattern B in this case.

In addition, in this representative embodiment, the selection device 14 may also include the power switch of an audio device (not shown but typically supplied as standard equipment for automobile). In the event that the power switch of the audio device is turned on, Control Pattern A may be selected even with the previous selection of the power mode via the operating mode selection switch. Therefore, the space within the vehicle cabin may be kept to a low level with respect to the intake air sound.

The control process of the control system 10 will now be described with reference to FIG. 3. If the driver operates the operating mode selection switch to select the normal mode in Step S101 (i.e., the determination in Step S101 is "YES"), the process proceeds to Step S103 so that Control Pattern A is selected for the electronic control unit (ECU) 12. Therefore, the motor 26*m* of the variable acoustical damping device 20 may be driven to bring the resonance frequency f to substantially coincide with the frequency F of the intake air sound corresponding to the rotational speed R of the engine 1 in Step 105. In other words, if the frequency F corresponding to the rotational speed R has been changed due to a change of the rotational speed R, the resonance frequency f may be adjusted in response to such changes of the frequency F. As a result, the intake air sound of the engine 1 may be significantly reduced, causing the vehicle cabin to be kept relatively silent.

If the driver operates the operating mode selection switch of the automatic transmission to select the power mode in Step S101 (i.e., the determination in Step S101 is "NO"), the process proceeds to Step S102. If the power switch of the audio device is not turned on (i.e., if the determination in Step S102 is "NO"), the process proceeds to Step S104, selecting Control Pattern B for the electronic control unit (ECU) 12. Therefore, in Step 106 the motor 26*m* of the variable acoustical damping device 20 may be driven to cause the resonance frequency f not to coincide with the frequency F of the intake air sound corresponding to the rotational speed R of the engine 1. In other words, the resonance frequency f may be shifted away from the frequency F of the intake air sound corresponding to the rotational speed R. As a result, the intake air sound of the engine 1 may be perceived as louder and present a relatively more powerful intake air sound. As a result, the driver can more easily enjoy sporty traveling.

Even if the operating mode selection switch of the automatic transmission is operated so as to select the power mode in Step S101, Control Pattern A may still be selected in Step S103 if the power switch of the audio device is turned on (i.e., if the determination in Step S102 is "YES"). Therefore, the intake air sound of the engine 1 may be reduced so that the vehicle cabin may remain relatively silent with regard to the intake air sound. As a result, the operator may more easily enjoy the playing of the audio device within the relatively more quiet vehicle cabin.

As described above, according to the control system 10 of the variable acoustical damping device 20, the control pattern of the electronic control device (ECU) 12 may be automatically changed between Control Pattern A and Control Pattern B, in response to the use conditions of the vehicle. Therefore, it is possible to dynamically present different levels of intake air sound via the variable acoustical damping device 20.

In particular, the selection device 14 instructs the selection of Control Pattern A (i.e., the acoustic damping pattern) if the normal mode has been selected by the operating mode selection switch of the automatic transmission. The selection device 14 instructs the selection of Control Pattern B (i.e., moderate acoustic damping pattern) if the power mode has been selected. In other words, if the driver wishes to enjoy the sound associated with powerful driving, the intake air sound may become relatively louder due to the selection of Control Pattern B. Therefore, a vigorous feeling through the resulting increase in engine feedback may be given to the driver during powerful and sporty traveling.

Although the representative embodiment has been described in connection with the control system 10 for controlling the variable acoustical damping device 20 disposed in the intake air path 5 (see FIG. 1), the variable acoustical damping device 20 may be disposed in an exhaust air channel (not shown), so that the control system 10 can be used for controlling the sound level of the exhaust.

In addition, although the control program of the electronic control unit (ECU) 12 drives the motor 26*m* in two different patterns (i.e., Control Pattern A and Control Pattern B) in the representative embodiment, the invention is not limited to only two different patterns. The control program may include various sub-patterns in addition to Control Pattern A and Control Pattern B in order to provide differently moderated levels of acoustical damping.

Further, although the operating mode selection switch of the automatic transmission and the power switch of the audio device have been used as the selection switch 14 in the above representative embodiment, a lighting switch 16*a*, an air conditioning switch 16*b*, a wiper switch 16*c* or a switch 16*d* for opening and closing a window(s), and a sensor(s) 16*e* for detecting the presence of a seated person(s), and the like, may be used alone or in combination with one another as the selection switch 14.

For example, when the lighting switch is turned on (e.g., such as during the night), the intake air sound or the exhaust sound may be significantly damped (i.e., Control Pattern B). Conversely, when the lighting switch 16*a* is turned off, the intake air sound or the exhaust sound may only be moderately damped (i.e., Control Pattern A). In another example, when the air conditioning switch 16*b* is turned on (e.g., or when the flow rate of the air supplied from the air conditioner is large), the intake air sound or the exhaust sound may only be moderately damped (i.e., Control Pattern A). Alternatively, when the air conditioning switch 16*b* is turned off, the intake air sound or the exhaust sound may be significantly damped (i.e., Control Pattern B). In a further example, when the wiper switch 16*c* is turned on and a window is opened (i.e., window regulator switch 16*d* has been operated to open a window), the intake air sound or the exhaust sound may only be moderately damped (i.e., Control Pattern A). However, when the wiper switch 16*c* is turned off and the window is closed, the intake air sound or the exhaust sound may be significantly damped (i.e., Control Pattern B). In a still further example, if the sensor(s) 16*e* for detecting a seated person(s) has detected plural persons sitting in the various vehicle seats, the intake air sound or the exhaust sound may be significantly damped (i.e., Control Pattern B) so as to not obstruct any conversation between the passengers of the vehicle.

This invention claimed is:

1. A control system for controlling a variable acoustical damping device disposed in a sound producing channel of a vehicle engine, comprising:

a controller coupled to the variable acoustical damping device and storing a plurality of control patterns for different levels of acoustical damping via the acoustical damping device, the controller being configured to produce a control signal that causes a characteristic of the acoustical damping device to be varied based on selected ones of the plurality of control patterns; and a selection device arranged and constructed to output a selection signal to the controller, the selection signal representing at least one vehicle condition related to a present use of the vehicle by at least one occupant thereof, the vehicle condition being unrelated to engine or transmission performance of the vehicle;

wherein the controller is configured to automatically determine the control signal to produce based on one of the plurality of control patterns corresponding to the selection signal according to one of a predefined set of associations of control patterns and selection signals, which associations represent desired sound levels in the sound producing channel based on various vehicle conditions.

2. The control system as in claim 1, wherein the variable acoustical damping device comprises a resonator having a variable resonance frequency, and wherein the control patterns of the controller comprise a first pattern and a second pattern, the first pattern controls the resonance frequency of the variable acoustical damping device to substantially coincide with a frequency of sound produced in the sound producing channel corresponding to the rotational speed of the vehicle engine; and the second pattern controls the resonance frequency of the variable acoustical damping device so as not to coincide with the frequency of sound produced in the sound producing channel corresponding to the rotational speed of the vehicle engine.

3. The control system as in claim 2, wherein the selection device further comprises a power switch of a vehicle audio device, and wherein the first pattern is selected based on a setting of the power switch of the audio device.

4. The control system as in claim 2, wherein the selection device comprises a vehicle lighting switch, and wherein the first pattern is selected when the lighting switch is turned on, and wherein the second pattern is selected when the lighting switch is turned off.

5. The control system as in claim 2, wherein the selection device comprises an air conditioning switch, and wherein the first pattern is selected when the air conditioning switch is turned off and wherein the second pattern is selected when the air conditioning switch is turned on.

6. The control system as in claim 2, wherein the selection device comprises a wiper switch, and wherein the first pattern is selected when the wiper switch is turned off, and wherein the second pattern is selected when the wiper switch is turned on.

7. The control system as in claim 2, wherein the selection device comprises a sensor for detecting a sitting of a person on a vehicle seat, and wherein the first pattern is selected when the sensor has detected the sitting of two or more persons on the vehicle seats, and wherein the second pattern is selected when the sensor has detected the sitting only of one person on the vehicle seat.

8. The control system as in claim 2, wherein the selection device comprises window regulator switches for opening and closing vehicle windows, and wherein the first pattern is selected when the window regulator switches have been operated so as to close all of the windows, and wherein the second pattern is selected when at least one of the window regulator switches has been operated to open at least one window.

9. The control system as in claim 1, wherein the selection device comprises at least one of an operating mode selection switch of a vehicle automatic transmission, a vehicle audio device, a vehicle lighting switch, a vehicle air conditioning switch, a wiper switch, a window regulator switch for opening and closing at least one vehicle window, or a sensor for detecting the sitting of at least one person on at least one vehicle seat.

10. The control system as claimed in claim 1, wherein the variable acoustical damping device comprises a resonator and wherein the characteristic of the acoustical damping device to be varied based on selected ones of the plurality of control patterns is a physical dimension of a resonant chamber of the resonator.

11. The control system as in claim 3, wherein the selection device further comprises a mode switch of a vehicle automatic transmission; and wherein one of the first pattern and the second pattern is selected based on a combination of settings of the power switch of the audio device and the mode switch of the automatic transmission.

12. A method of controlling sound produced in a sound producing channel of a vehicle engine, the method comprising:

producing, via controller storing different control patterns with respect to levels of acoustical damping, a control signal that causes a level of acoustical damping to be varied based on selected ones of the plurality of control patterns;

selecting one of the control patterns based on at least one detected vehicle condition related to a present use of the vehicle by at least one occupant thereof, the detected vehicle condition being unrelated to engine or transmission performance of the vehicle, wherein said one of the control patterns is selected from among a predefined set of associations of control patterns and vehicle conditions, which associations represent desired sound levels in the sound producing channel under various circumstances; and controlling, via the control signal, the sound produced according to the selected control pattern.

13. The method as in claim 12, wherein the selecting comprises detecting at least one vehicle condition including at least one condition selected from the group consisting of: an operating condition of a vehicle audio device, a setting of a vehicle lighting switch, an operating condition of a vehicle air conditioner, a setting of a wiper switch, a condition of a sensor for detecting at least one seated person, at least one window regulator condition, or any combination thereof.

14. The method as in claim 13, wherein the controlling comprises varying the level of acoustical damping of an acoustical damping device disposed in the sound producing channel;

wherein the control pattern includes at least a first control pattern and a second control pattern, wherein the first control pattern provides a maximum possible level of damping effect by the acoustical damping device, and wherein the second control pattern provides the level of damping effect smaller than the maximum level of damping effect.

15. method as claimed in claim 14, wherein the acoustical damping device comprises a variable resonator having a resonant chamber, and wherein varying the level of acoustical damping includes varying a physical dimension of the resonant chamber.

* * * * *